United States Patent [19]

Doyle

[11] Patent Number: 4,939,709

[45] Date of Patent: Jul. 3, 1990

[54] ELECTRONIC VISUAL DISPLAY SYSTEM FOR SIMULATING THE MOTION OF A CLOCK PENDULUM

[76] Inventor: Sean Doyle, 49 Plymouth St., East Bridgewater, Mass. 02333

[21] Appl. No.: 366,594

[22] Filed: Jun. 15, 1989

[51] Int. Cl.[5] ..... G04C 17/02

[52] U.S. Cl. ..... 368/241; 368/134; 368/179; 368/165

[58] Field of Search ..... 368/240–242, 368/134, 179, 165

[56] References Cited

U.S. PATENT DOCUMENTS 4,041,692 8/1977 Marshino ..... 368/240

OTHER PUBLICATIONS

Radio Electronics "Unusual Electronic Clocks", pp. 41–45, 100, Apr. 1978.

*Primary Examiner*—Bernard Roskoski

*Attorney, Agent, or Firm*—William Nitkin

[57] ABSTRACT

A visual device for simulating the motion of a clock pendulum consisting of a series of light emitting diodes having the property of emitting two distinct colors and electronic logic arranged to activate sequentially the series in one color in one direction and in the other color in the opposite direction.

2 Claims, 1 Drawing Sheet

ELECTRONIC VISUAL DISPLAY SYSTEM FOR SIMULATING THE MOTION OF A CLOCK PENDULUM

BACKGROUND OF THE INVENTION

1. Field of the Invention

The invention resides in the field of electronic visual displays.

2. Description of the Prior Art

Electronically activated visual displays are well known in the prior art. For example, there are numerous configurations of light pattern alterations or changes to be found in public billboard displays. The same concept has also been applied to the operation of the lights which accompany the performance of modern or rock music.

SUMMARY OF THE INVENTION

The invention may be summarized as a visual display for simulating the motion of a clock pendulum in which a series of tri light-emitting diodes (tri-LEDs), i.e., those diodes that display alternately in two separate and distinct colors, are arranged in a substantially semi-circular array and are sequentially activated from one end of the series to the other in first one color and back again in the second color. The visual display may be positioned below a clock face for decorative appearance as a pendulum of such clock.

The electronic circuitry to carry out this function is preferably in the form of integrated circuits and consists of a clock for generating time pulses, a counter responsive to said clock for emitting a signal upon the accumulation of a selected number of such pulses, and logic circuitry in the form of Programmable Read-Only Memories (PROMs), responsive to the counter for activating the tri-LEDs in the desired sequence. The usual result of the system is an apparent travelling or oscillating light display which simulates the swing of a clock pendulum with the additional features of color change from one direction to the other.

The operation and design of the appropriate circuitry will become clearer from the Description of the Preferred Embodiment and drawings which follow.

DESCRIPTION OF THE PREFERRED EMBODIMENT(S)

Figure 1:
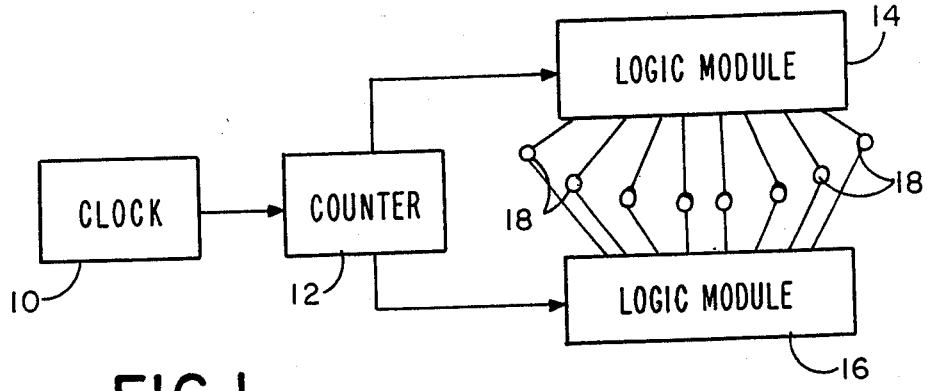
FIG. 1 is a block diagram of the preferred embodiment of the system of this invention.

FIG. 1 illustrates a block diagram of the preferred embodiment of the display system of this invention in which clock 10 generates timing pulses, counter 12 emits a signal upon the accumulation of a selected number of such pulses and logic modules 14 and 16 activate a series of tri-LEDs 18 in response to the commands of counter 12. As shown, the tri-LEDs are arranged in a semicircle to more specifically mimic the path followed by a pendulum bob during the back and forth motion swing of a pendulum clock. Typical alternative colors of the tri-LEDs are green and red.

Figure 2:
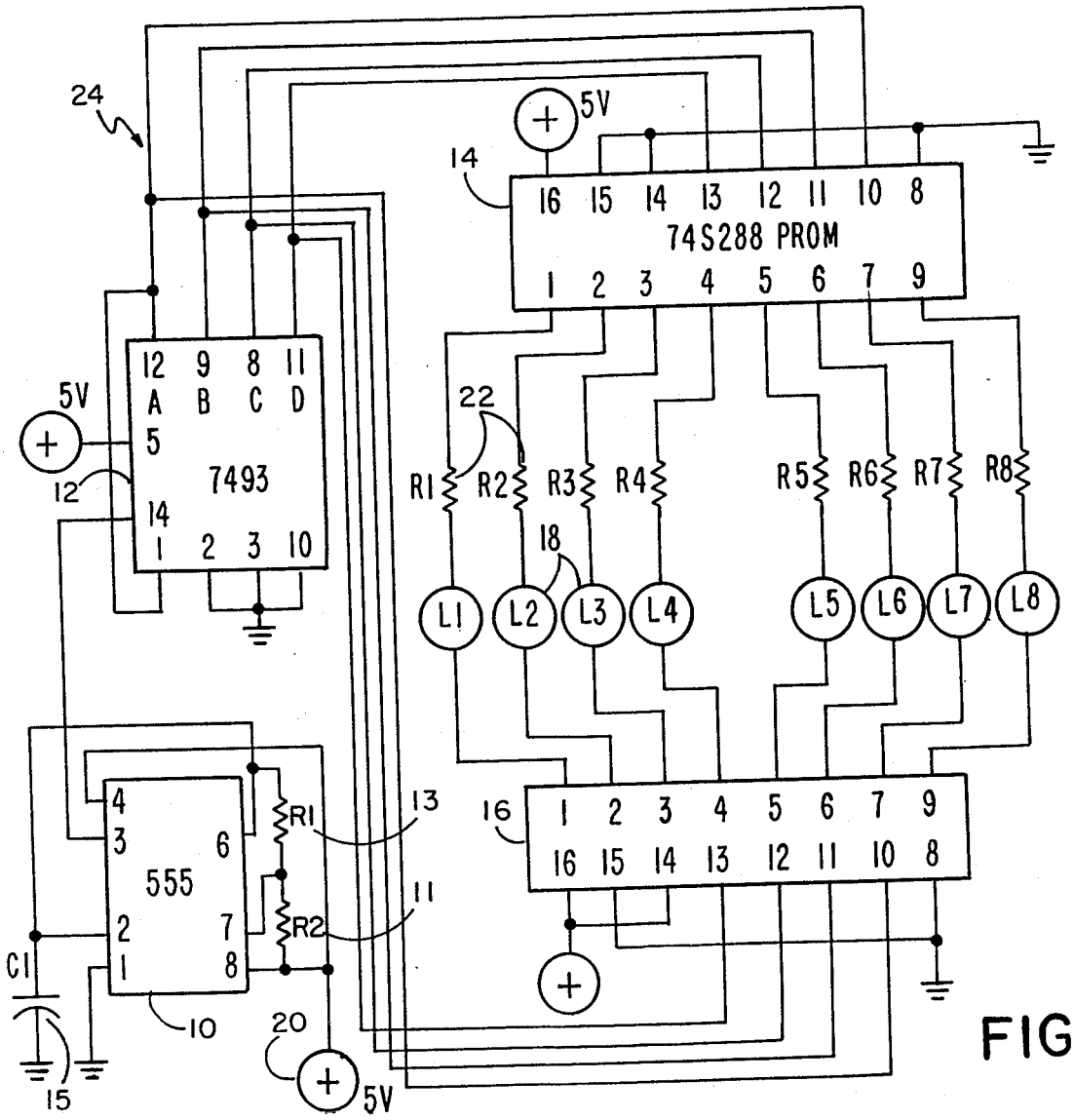
FIG. 2 is a detailed schematic drawing of the preferred embodiment of FIG. 1.

Referring next to FIG. 2, a detailed schematic based on the block diagram of FIG. 1 for practicing the invention is illustrated. Clock 10 consists of an LM555 or equivalent timer integrated circuit powered by a 5 volt power supply 30 and interconnected to resistors 11 and 13, and capacitor 15, the values of which are chosen to produce a square wave of 8 hz which will develop 8 counts per second. A typical value for capacitor 15 is 1 mfd; for resistors 11 and 13, between 80–100K ohms. Counter 12 consists of a 7493 integrated circuit chip or equivalent binary counter, and logic modules 14 and 16 consist of two 745288 Programmable Read Only Memories (PROM) or equivalent which are set to opposite states of logic. This arrangement allows both PROMs of logic modules 14 and 16 to be impressed with the same program which, for example, can consist of the following:

| PROM | | | PROGRAM | | |
|---|---|---|---|---|---|
| Address | | Data | Address | | Data |
| 00 | - | 80 | 10 | - | 00 |
| 01 | - | 40 | 11 | - | 00 |
| 02 | - | 20 | 12 | - | 00 |
| 03 | - | 10 | 13 | - | 00 |
| 04 | - | 08 | 14 | - | 00 |
| 05 | - | 04 | 15 | - | 00 |
| 06 | - | 02 | 16 | - | 00 |
| 07 | - | 01 | 17 | - | 00 |
| 08 | - | 00 | 18 | - | 01 |
| 09 | - | 00 | 19 | - | 02 |
| 0A | - | 00 | 1A | - | 04 |
| 0B | - | 00 | 1B | - | 08 |
| 0C | - | 00 | 1C | - | 10 |
| 0D | - | 00 | 1D | - | 20 |
| 0E | - | 00 | 1E | - | 40 |
| 0F | - | 00 | 1F | - | 80 |

The tri-LEDs 18 are arrayed interconnected between the respective contacts 1–9 of PROMs 14 and 16 with resistors 22 interconnected between each of the tri-LEDs 18 and PROM 14. Resistors 22 can be 220–1K ohms. In accordance with the above, the circuit will now function in the following manner:

When address bus lines 1, 2, 3, and 4 designated by 24 are at 00 state, PROM 14 pin 1 is at logic 1 while the remaining seven pins are at logic 0 and PROM 16 pin 1 and remaining seven pins are also at logic 0, thereby setting up a "red color bias" on the pin 1 tri-LED with the remaining tri-LEDs being off. When address bus 24 lines 1, 2, 3, and 4 are at 01 state, PROM 14 pin 2 is at logic 1 while the remaining seven pins are at logic 0 and PROM 16 pin 2 and remaining seven pins are also at logic 0, thereby setting up a "red color bias" on the pin 2 tri-LED with the remaining tri-LEDs being off. This "red color bias" sequence correlation continues through to the address count 07 state. Starting on count 08 of the address bus, PROM 16 pin 9 is at logic 1 while the remaining seven pins are at logic 0 and PROM 14 pin 9 and remaining seven lines are at logic 0. This change of polarity changes the "red color bias" at the pin 9 tri-LED to a "green color bias" condition with the remaining seven tri-LEDs being off. The "green color bias" condition sequences through until the address bus reaches OF at which point the counter resets to zero and the sequence starts over again. The circuit, being based on a TTL logic, has pin 14 of each PROM 14 and 16 at an opposite state of logic with pin 14 of PROM 14 connected to ground, and pin 14 of PROM 16 connected to +5 volts. In operation, when PROM 14 pin 14 is at logic 0, it utilizes the "lower" half of the program burned in PROM 14. At the same time PROM 16, pin 14 is at logic 1 and utilizes the "upper" half of the program burned therein. For the first eight counts the program results in the pins of one of the two PROMs sequentially staying at logic 0 while the pins of the other PROM will each sequentially be at logic 1. During the second eight counts the program will produce the opposite effect on the PROMs with the PROM formerly at logic 0 then being at logic 1 and the PROM formerly at logic 1 then being at logic 0. Thus an electronic visual display of a pendulum is created appearing to "swing" back and forth, in one direction sequentially flashing red and sequentially flashing green in the other direction.

Although the present invention has been described with reference to particular embodiments, it will be apparent to those skilled in the art that variations and modifications can be substituted therefor without departing from the principles and spirit of the invention.

I claim:

1. A visual display system for simulating the motion of a clock pendulum comprising in combination:

clock means for generating timing pulses;

counting means for counting said timing pulses and for generating a count signal upon the accumulation of a selected number of said pulses;

a series of tri-light emitting diodes (tri-LEDs) arrayed in a semi-circular array, each tri-LED having the property of alternatively emitting two distinct colors; and logic means responsive to said count signal, said logic means arranged to activate sequentially said tri-LEDs in one of said colors from the beginning to the end of said series and to then activate sequentially said tri-LEDs in the other of said colors from the end to the beginning of said series.

2. The system of claim 1 wherein said logic means comprises a pair of Programmable Read Only Memories (PROMs) of the same configuration set to opposite states of logic with said tri-LEDs interconnected between respective contacts of said PROMs.

* * * * *